US005951716A

United States Patent [19]

Lucia, III et al.

[11] Patent Number: 5,951,716

[45] **Date of Patent: *Sep. 14, 1999**

[54] HOME DRYER DRY CLEANING AND FRESHENING SYSTEM EMPLOYING DRYER CLEANING BAG

[75] Inventors: Frank Anthony Lucia, III, Oak Ridge; Stephen Vito Dente, Tenafly; Tracy Ann Ryan, Rivervale; Michael Richard Tyerech, Fort Lee; Anthony Domenic Sidoti, Pompton Plains; Stanislaw Kepka, Ringoes, all of N.J.

[73] Assignee: Reckitt & Colman Inc., Wayne, N.J.

[ * ] Notice: This patent is subject to a terminal disclaimer.

[21] Appl. No.: 08/665,475

[22] Filed: Jun. 18, 1996

[30] Foreign Application Priority Data

Jun. 22, 1995 [GB] United Kingdom ..... 9512695
Mar. 7, 1996 [GB] United Kingdom ..... 9604828

[51] Int. Cl.[6] ..... D06L 1/00; D06M 23/00; D06M 23/02

[52] U.S. Cl. ..... 8/142; 8/137; 510/276; 510/281; 510/282; 510/283; 510/284; 510/285; 510/289; 510/293; 510/294; 510/295; 510/297; 510/277; 442/59; 442/170; 442/164; 442/169

[58] Field of Search ..... 8/137, 142; 510/276, 510/281, 282, 283, 284, 285, 289, 293, 295, 294, 297, 277; 442/59, 170, 164, 169

[56] References Cited

U.S. PATENT DOCUMENTS

| | | | |
|---|---|---|---|
| 3,432,253 | 3/1969 | Dixon et al. | 8/142 |
| 3,813,221 | 5/1974 | Stubits | 8/142 |
| 3,859,225 | 1/1975 | McKnight et al. . | |
| 3,910,855 | 10/1975 | Abeles . | |
| 3,953,353 | 4/1976 | Barrett, Jr. et al. . | |
| 4,097,397 | 6/1978 | Mizutani et al. . | |
| 4,231,744 | 11/1980 | Moot | 8/495 |
| 4,336,024 | 6/1982 | Denissenko et al. | 8/142 |
| 4,430,468 | 2/1984 | Schumacher | 524/109 |
| 4,435,346 | 3/1984 | Ito et al. . | |
| 4,548,954 | 10/1985 | Smith et al. | 521/52 |
| 4,563,483 | 1/1986 | Smith et al. | 521/111 |
| 4,594,362 | 6/1986 | Smith et al. | 521/52 |
| 4,613,646 | 9/1986 | Sandvick | 524/476 |
| 4,632,772 | 12/1986 | Garabedian et al. . | |
| 4,670,171 | 6/1987 | Magyar . | |
| 4,680,143 | 7/1987 | Edge et al. . | |
| 4,685,930 | 8/1987 | Kasprzak | 8/139.1 |
| 4,720,351 | 1/1988 | Flynn et al. . | |
| 4,738,791 | 4/1988 | Ertle . | |
| 4,738,792 | 4/1988 | Ertle . | |
| 4,834,900 | 5/1989 | Soldanski et al. . | |
| 4,880,569 | 11/1989 | Leng et al. . | |
| 4,992,107 | 2/1991 | Itoku et al. | 134/27 |
| 5,205,960 | 4/1993 | Kristopeit et al. . | |
| 5,238,587 | 8/1993 | Smith et al. . | |
| 5,547,476 | 8/1996 | Siklosi et al. | 8/142 |
| 5,658,651 | 8/1997 | Smith et al. | 442/59 |
| 5,681,355 | 10/1997 | Davis et al. | 8/137 |
| 5,746,776 | 5/1998 | Smith et al. | 8/142 |
| 5,865,851 | 2/1999 | Sidoti et al. | 8/142 |
| 5,876,462 | 3/1999 | Weller et al. | 8/142 |

FOREIGN PATENT DOCUMENTS

| | | |
|---|---|---|
| 0 429 172 A1 | 5/1991 | European Pat. Off. . |
| 9428162 A1 | 5/1991 | European Pat. Off. . |
| 26 28 480 | 1/1978 | Germany . |
| 1 471 886 | 4/1977 | United Kingdom . |
| 1 536 936 | 12/1978 | United Kingdom . |
| 1 598 911 | 9/1981 | United Kingdom . |
| 1598911 | 9/1981 | United Kingdom . |
| 2 169 916 | 7/1986 | United Kingdom . |
| WO 91/14038 | 9/1991 | WIPO . |
| WO 95/31523 | 11/1995 | WIPO . |

*Primary Examiner*—Alan Diamond
*Attorney, Agent, or Firm*—Fish & Richardson P.C.

[57] ABSTRACT

A containment bag 1 which may be used in home dry cleaning is made of textile with an impermeable finish and an interior capable of absorbing loose particles and soil. The containment bag 1 is used in a home dryer dry cleaning and freshening system. The textile of the containment bag 1 has a layer of woven or knit fabric with an impermeable coating and a soft, hairy layer on its interior. The inside of the containment bag 1 is prewetted with cleaning composition. Preferably a liquid cleaning composition is employed and the cleaning composition may include a fragrance composition. A process for cleaning a garment is also provided.

20 Claims, 2 Drawing Sheets

HOME DRYER DRY CLEANING AND FRESHENING SYSTEM EMPLOYING DRYER CLEANING BAG

This invention generally relates to a system for dry cleaning and freshening garments. More particularly the present invention relates to a dry cleaning and freshing system which utilizes a dryer apparatus, as well as a method of dry cleaning and freshening garments, particularly in a domestic setting.

Certain methods of dry cleaning and freshening garments have been described in the relevant prior art.

Smith et al., in U.S. Pat. No. 5,238,587, issued Aug. 24, 1993 disclose a method for cleaning soiled fabric articles comprising tumbling the soiled articles in a rotary clothes dryer at an elevated temperature, in a closed system, such as a sealed plastic bag. The system also includes a fabric-cleaning article comprising a porous substrate sheet impregnated with a gelled liquid cleaning composition. Such a system however is not without its shortcomings. When a gelling agent is used as the cleaning composition, a visible residue may be deposited on the garment to be cleaned. Further, a gel is only needed to coat sheets of material which do not otherwise absorb a sufficient amount of dry-cleaning composition. Additionally, when a gelled dry-cleaning composition is employed, a temperature sufficient to cause release of the dry-cleaning coating composition from the cleaning sheet is required.

Denissenko et al., in U.S. Pat. No. 4,336,024 issued Jun. 22, 1982 discloses a process for cleaning clothes at home with the aid of a solvent by treating the article of clothing with a cleaning agent comprising at least one organic solvent, and then laying the article of clothing flat on an absorbent sheet, and laying the article of clothing and absorbent sheet flat on the interior surface of a the drum of a washing machine in order to spin it. The process may be carried out in two successive stages using a stain-removing agent and a rinsing agent. The garments must however, be held against the sheet on the interior surface of the drum, where they of course are subject to the effects of gravity and thus require the use of clips or straps in order to retain their positions until centripetal forces retain them against the drum's inner wall surface.

Dixon, in U.S. Pat. No. 3,432,253 issued Mar. 11, 1969, discloses a dry cleaning process involving placing in an air impermeable bag a fabric to be cleaned and a quantity of substantially dry cleaning agent, sealing the bag, tumbling the bag to cause the cleaning agent to clean the fabric, removing the clean fabric from the bag and removing the cleaning agent from the fabric. The cleaning agent is removed from the fabric by continuing tumbling of the fabric outside of the bag. In the Dixon process, a flexible bag made of a material substantially impermeable to air leakage is employed. Dixon discloses the use of a conventional polyethylene bag. The bags are reuseable. When a substantially dry dry-cleaning agent is employed, as in the Dixon '253 patent, a finishing cycle to remove the cleaning agent is necessary. Further, the cleaning agent is carried by a vehicle such as fine sawdust or ground wood which must be collected in a suitable trap in the tumbling machine which is inappropriate for use with a home dryer without damaging the dryer. Further, the finishing cycle has all the disadvantages of friction damage and stretching of the fabric garment due to tangling of the garments during tumbling outside a bag.

In the Smith et al. '587 patent and the Dixon '253 patent, the impermeable properties of the bag are achieved by employing a plastic bag. Users are found to have a negative perception of plastic bags, particularly, if the bags are inflexible and rough to the touch. Further, a partly rigid plastic bag may cause damage to delicate clothing. Friction damage may result with a plastic bag.

As has been recited above, each of these systems and compositions are not without their shortcomings.

Accordingly, there is a need for a dryer dry cleaning and freshening system employing an absorbent material which is capable of absorbing a sufficient amount of dry-cleaning fluid. Further, there is a need for a dryer dry cleaning and freshening system which does not result in the deposition of a visible residue on the garment to be cleaned. Additionally, there is a need for a dryer dry cleaning and freshening system employing low temperature levels. There is a need for a dryer dry cleaning and freshening system which does not require a finishing cycle and where dry cleaning agent need not be cleaned from the dryer.

There is a need for the above systems for use at home.

It is a general object of the invention to provide a dryer dry cleaning and freshening system.

A further object of the invention is to provide a dryer dry cleaning and freshening system which is inexpensive and simple to use.

It is a further object of the invention to provide a dryer dry cleaning and freshening system which does not result in deposition of a residue on the garments to be cleaned.

It is another object of the invention to provide a dryer dry cleaning and freshening system for use at low temperatures.

It is an object of the invention to provide a dryer dry cleaning and freshening system which does not require a finishing cycle.

It is still a further object of the invention to provide a dryer dry cleaning and freshening system with an absorbent material that absorbs a sufficient amount of dry-cleaning liquid composition.

It is an object of the invention to provide a dryer dry cleaning and freshening system which does not use a dry cleaning agent which must be cleaned from the dryer.

It is yet another object of the invention to provide a dryer dry cleaning and freshening system with a cleaning bag that is soft to the touch, reduces friction damage and will not damage delicate clothing.

It is an even further object of the invention to provide a dryer dry cleaning and freshening system with a cleaning bag which is impermeable yet made of textile.

It is another further object of the invention to provide a process for cleaning a soiled garment with a cleaning composition in a dryer.

It is an additional object of the invention to provide a process for refreshening a garment with a freshening composition in a dryer.

It is an object of the invention to provide the above systems and processes for use at home.

These and other objects of the invention are accomplished by providing a dryer dry cleaning and freshening system comprising a cleaning composition and a containment bag 1 of textile with an impermeable finish and an interior capable of absorbing loose particles and soil. Such a cleaning composition is desirably a liquid cleaning composition.

In accordance with one preferred embodiment of the invention, there is provided a containment bag 1 fabricated of a material such as a bilayered or composite film or textile construction having a vapor impermeable or poorly permeable finish on its exterior and an interior finish capable of entrapping or entraining loose particles and soil. The interior of the containment bag 1 can be an absorbing material which absorbs any excess liquid cleaning composition.

In another embodiment of the invention there is provided a process for cleaning a garment with cleaning composition comprising the steps of applying a quantity of a cleaning composition to one or more surfaces of a containment bag 1, placing at least one garment in the containment bag 1 where said bag 1 is fabricated of a material such as a bilayered or composite film or textile construction having a vapor impermeable or poorly permeable finish on its exterior and an interior finish capable of entrapping or entraining loose particles and soil, fastening shut the containment bag 1, tumbling the containment bag 1 and its contents in a clothes dryer, and removing the cleaned garment from the clothes dryer and containment bag 1.

In a further preferred embodiment of the invention a process for freshening a garment with a fragrance composition comprises the steps of preapplying a containment bag 1 with fragrance composition, placing at least one garment in the containment bag 1 as described immediately above, fastening shut the containment bag 1, tumbling the containment bag 1 and its contents in a clothes dryer and removing the freshened garment from the clothes dryer and containment bag 1.

The above and other objects, aspects, features and advantages of the invention would be more readily apparent from the description of the preferred embodiments taken in conjunction with the accompanying drawings and appended claims.

The invention is illustrated by a way of example and not limitation in the figures of the accompanying drawings in which like references denote like and corresponding parts and in which:

Figure 1:
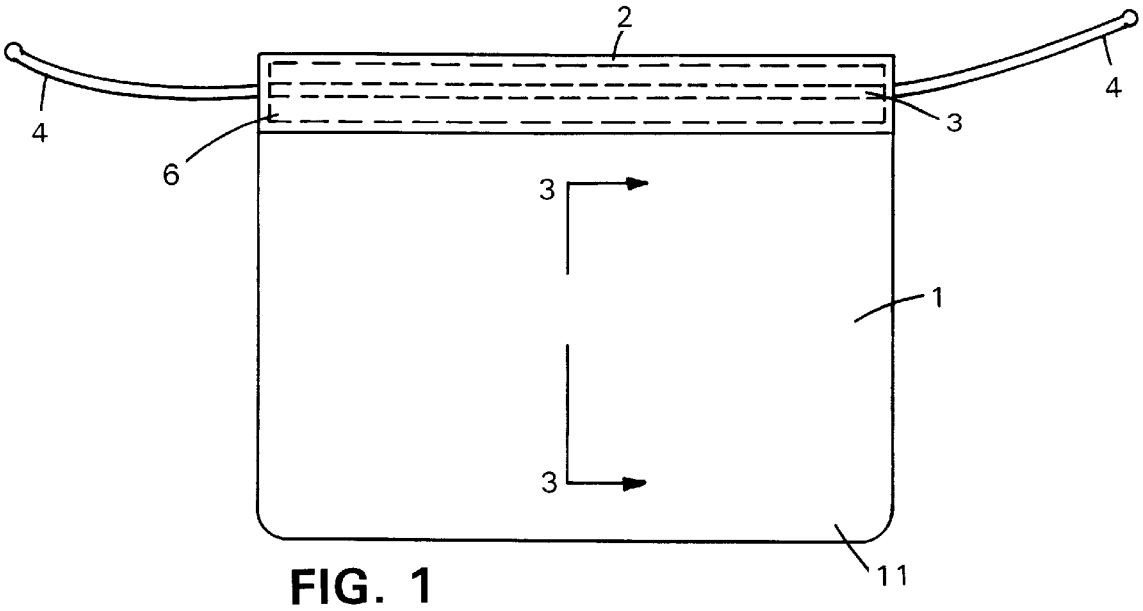
FIG. 1 is a schematic drawing of a containment bag 1 for use in a dryer dry cleaning and freshening system in accordance with the invention.
Figure 2:
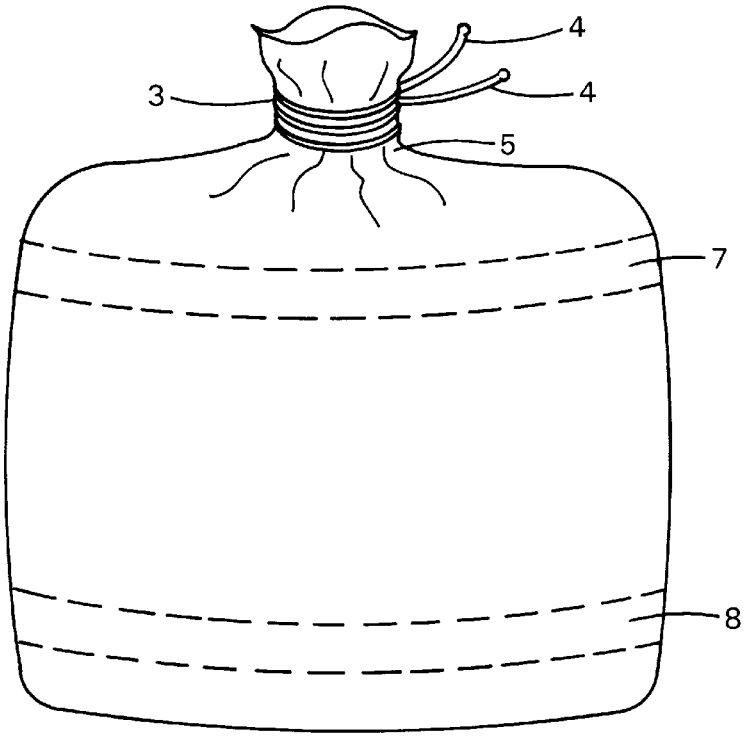
FIG. 2 is a schematic drawing of another embodiment of the containment bag 1 in accordance with the present invention.

As has been noted previously, the dryer dry cleaning and freshening system of the invention preferably includes a containment bag 1 as shown in FIG. 1. Such containment bag 1 with an opening 2 on one side, although it may be located elsewhere on the containment bag 1. The containment bag 1 may be fastened shut with any of a variety of suitable fastener means, which is indicated on FIG. 1 as shown by the dashed line 3. Exemplary fastener means include, but are not limited to: zippers, hook-and-loop type fasteners (VELCRO®), buttons, clips, pins, snaps, adhesive strips, as well as resealable plastic sealing elements such as two strips, one on each margin of the opening 2 when pressed together interlock to form a flexible seal. Such resealable plastic sealing elements are known to the art dealing with plastic bags and pouches, and are sometime referred to as ZIP-LOCK® type closures. Suitable fastening means also includes the use of a simple drawstring to pull the opening 2 shut, or the use of a single deformable wire-type "twist tie" to close the opening 2, as well as the use of one or more fastening means in conjunction with a flap (not shown). Most desirably, as is illustrated on FIG. 1, the fastener means is a drawstring inserted in a corresponding sheath. The ends of the drawstring 4 may be simply pulled to gather the top of the containment bag 1 as shown in FIG. 2. The ends of the drawstring may then be tied and/or wrapped around the top of the containment bag 1 to form a throat 5 as shown in FIG. 2. In order to improve the sealing properties of the containment bag 1, a soft sponge-like material 6 as shown by the short and long dashed lines in FIG. 1 is advantageously located around the opening of the containment bag 1 on the inside of the bag to provide a seal. This sponge-like material 6 may be a laminated structure. The containment bag 1 may be sized so that more than one garment fits in the containment bag 1.

Desirably, the containment bag 1 is formed of a material which is liquid-and vapor impermeable, and which also has a textile like feel. It is to be understood that while such a liquid- and vapor impermeable material may be used in the construction of the containment bag 1, it is to be understood that such a bag itself need not be totally hermetically sealable itself and that the escape of vapors or gases from within such a containment bag 1 to its exterior, such as the interior space of a clothes dryer is to be foreseen. Such an escape of vapors may occur at seams of said containment bag 1, particularly where sewn seams are present, as well as from the opening.

Useful materials which have a textile like feel include for example a variety of known woven or non-woven textile material, which may be made of naturally occuring or synthetically produced fibers, as well as blends of two or more different materials. Such may be vapor permeable, and in order to provide the vapor impermeable characteristics required of the containment bag 1 as being described herein, a vapor impermeable material such as a resin finish or a polymeric film may be bonded to this textile material to form a multilayer construction having as two or more layers of differing materials layered in register, wherein at least one layer is a vapor impermeable barrier layer and at least a second layer provides a textile like feel, which may of course be provided by a woven or non-woven textile material. Such woven or non-woven textile material desirably has a fleecy surface or is otherwise suited for the entrainment or entrapment of loosened soils and particulates. A second example of multilayer containment bag construction includes a first innermost layer which is a fibrous material, such as a non-woven material and a second layer in register therewith of a non-woven vapor impermeable synthetic paper-like material such as TYVEK material which is used to form the exterior of the containment bag 1. Such a construction provides the advantage of providing a vapor impermeable containment bag 1, which has a durable exterior layer which in turn increases the operating life of such a containment bag. At the same time, the innermost layer having a has a fleecy surface or is otherwise suited for the entrainment or entrapment of loosened soils and particulates. Further, the exterior material made of TYVEK or a similar material is readily printable using known art techniques which permits the printing of a legend, logo or instructions for use on this exterior surface of the containment bag 1. A third preferred material of construction useful in the fabrication of a containment bag 1 is a two or three layered material, wherein the first and innermost layer of the containment bag 12 is of a non-woven, fibrous material such as of a synthetically produced fiber, or is a spun bonded polymeric textile material, either of which have a fibrous surface which is adapted to entrain or entrap loosened soils and particulates from a garment being cleaned with the system and process being taught herein. This third preferred material of construction further includes at least a second outermost layer which forms a vapor barrier, i.e., is vapor and liquid impermeable and such may be any of a variety of known polymeric films or resins including for example polyalkylenes such as polyethylene, polypropylene or polybutylene, nylons polyalkylene terephthalates, as well as copolymers thereof.

The containment bag 1 desirably further includes a flexible support structure such as one or more plastic rings 7 and 8, as is illustrated by the dotted lines on FIG. 2. The interior of the containment bag 1 may include one or more loops, sleeves or other means for retaining the flexible support structure in a fixed position with respect to the containment bag 1. These flexible rings 7 and 8 are useful as aiding in the support of the shape of the containment bag 1.

The containment bag 1 of the present invention may be reusable, and in its preferred embodiments is washable in a conventional laundering process. The containment bag 1 may be reused a limited number of times before it needs to be washed.

Where the containment bag 1 is washed, the flexible support structure, namely the flexible rings 7 and 8 may be removed from the containment bag 1 may be washed in a washing machine.

It is to be understood that in any of the constructions recited which include one or more polymeric materials, that minor amounts of conventional additives may be included in conventional amounts including but not limited to: colorants, heat stabilizers, ultraviolet stabilizers and filler materials. Such are, per se, known to the art.

Both of the at least first layers and the at least second layers may be of the same or different thicknesses, and it is required only that the containment bag 1 formed from these materials be flexible. Most desirably however, the thicknesses of both the first and second layer are less than about 20 mils, more desirably the thickness of the first, preferably vapor impermeable layer is 5 mils and less, especially 3 mils and less, while the thickness of the second layer and any further layer is about 5 mils and less.

The dimensions of the containment bag 1 and its internal volume may vary considerably. Desirably however, the containment bag 1 is sufficiently large to contain at least one garment or textile to be treated, but preferably 2–3 such garments, as well as the absorber means being taught herein, while at the same time not be overly large and thus be inconvenient for use in a domestic dryer apparatus. Advantageously the containment bag 12 has a volume of about 75 liters or less, with sizes of about 50 liters, and about 30 liters being preferred.

In accordance with a further aspect of the invention the containment bag 1 is used in conjunction with a cleaning composition, desirably a liquid cleaning composition. Typically such a liquid cleaning composition comprises one or more solvents and/or one or more surfactant constituents which may be employed to solubilize stains, and such cleaning compositions may be provided as part of an aqueous, or as part of an organic fluid delivery system. Compositions which comprise a fragrance constituent, with or without additional solvents and or surfactant constituents may also be used. Such surfactants and solvent, where present are generally known to aid in the removal of soils and stains from the garment or textile being treated in the process being taught herein. Exemplary useful liquid cleaning compositions include those which are known to the skilled practitioner in the art, and include those disclosed in any of the patents which are recited above, the contents of which are herein incorporated by reference. Further useful cleaning compositions which may be used include those which are the subject of copending patent applications Ser. No. 08/666,689 now U.S. Pat. No. 5,865,851 as well as the compositions which are taught as localized stain treating compositions, viz., spot treatment compositions which are described in Ser. No. 08/666,690 now U.S. Pat. No. 5,908, 473 the contents of both applications which are herein incorporated by reference.

In summary, many known art compositions include a proportion of one or more water miscible organic solvents such as one or more alcohols, polyols, ketones, or glycol ethers. Pyrrolidinone solvents are also known, as well as conventional chlorinated dry-cleaning solvent and mixtures of the foregoing as long as the final cleaning composition has a flash point above 160° F.

Many known art compositions include one or more surfactants, including nonionic surfactants as well as amphotheric solvents.

Exemplary nonionic surfactants include condensation products of ethylene oxide with a hydrophobic polyoxyalkylene base formed by the condensation of propylene oxide with propylene glycol. Preferred nonionic surfactants include the condensation products of $C_8$–$C_{22}$ alkyl alcohols with 2–50 moles of ethylene oxide per mole of alcohol. Preferred nonionic surfactants also include ($C_8$–$C_{24}$) fatty acid amides, e.g. the monoamides of a mixture of arachidic and behenic acid and the mono- or di-alkanolamides of ($C_8$–$C_{22}$) fatty acids. Further nonionic surfactants which may be employed include the ethylene oxide esters of $C_6$–$C_{12}$ alkyl phenols such as (nonylphenoxy) polyoxyethylene ether. Other nonionics include the ethylene oxide esters of alkyl mercaptans, the ethylene oxide esters of fatty acids and the lauric ester of methoxypolyethylene glycol, the ethylene oxide ethers of fatty acid amides, the condensation products of ethylene oxide with partial fatty acid esters of sorbital, wherein the mole ratio of ethylene oxide to the acid, phenol, amide or alcohol is about 5–50:1. Amphoteric surfactants many of which are known to the art, including ($C_8$–$C_{22}$) alkyl(dimethyl)amine oxides may also be present. Further useful amphoteric surfactants are known to the art, e.g., as disclosed in U.S. Pat. No. 3,936,538

Certain general liquid cleaning compositions include certain cationic surfactants is referred to as quaternary amines, which have been found to function to function as fabric conditioners, reducing static cling and lint adherence. Also useful in certain general cleaning composition include certain imidazolinium salts and useful amine salts like the stearyl amine salts that are soluble in water.

Additionally water may be present in the liquid cleaning composition. Generally, sufficient water is employed to aid in the removal of water based stains.

The liquid cleaning composition and fragrance composition should be such that there is little or no skin and eye irritation and preferably, no toxicity. Preferably a sufficient quantity of liquid cleaning composition is provided to clean three garments per dry cleaning load.

The liquid cleaning composition should also exhibit a sufficiently low flash point so to minimize and for all intensive purposes eliminiate the likelihood of combustion when used in the cleaning process described above.

The liquid cleaning composition may include a fragrance, deodorant, preservative, insect repellent such as cedar oil, a coloring agent, finishing agents, fumigants, lubricants, and fungicides, as long as the additives do not interfere with the operation of the composition. The liquid cleaning composition may also include amounts of a thickener or gelling agent.

As used in this specification the term "liquid cleaning composition" is to be understood to encompass cleaning compositions which may or may not include one or more "freshening" agents, typically one or more fragrances which are directed to provide a freshening effect. Alternately is it also to be understood that the "liquid cleaning composition" comprises one or more freshening agents, but no solvents and/or surfactant constituents for the solubilization of stains. In the case of the latter, the system and process of the invention generally provides only a freshening effect to garments being treated.

As used throughout this specification and in the claims, the use of the terms "garments" and "textiles" are used to describe for example finished articles such as pants, shirts, blouses, scarves, other articles of clothing, apparel, coats, and the like. In the case of the former term, while in the case of the latter term, textiles which are produced but have not been as of yet produced into either pieced goods or finished articles such as articles of clothing or apparel is intended to be meant by the latter term. In either case, as the present invention is equally applicable and useful without distinction or regard for both textiles and/or garments, they are to be understood as to interchangeable terms with respect to the cleaning operations and clearing compositions according to the instant invention.

What is to be understood by the term as "dryer" or "dryer apparatus" is a rotary dryer which generally is typical of a domestic rotary dryer. The only requirement is that the drum be configured so as to retain garments and/or textiles therein, to be rotatable, and that the interior of the drum may be heated to at least the temperature at which the lowest boiling point constituent volatilizes. Domestic clothes dryers, as well as commercial clothes dryers, particularly of the rotary type and most particularly those which rotate about a non-vertical axis are to be clearly understood as encompassed within the scope of the instant invention.

Although the invention has been described with reference to the preferred embodiments, it will be apparent to one skilled in the art that variations and modifications are contemplated within the spirit and scope of the invention. The drawings and the description of the preferred embodiments are made by way of example rather than to limit the scope of the invention, and it is intended to cover within the spirit and scope of the invention all such changes and modifications.

The dry clearing and freshening system is preferably for use in a home dryer and provides for the removal of spots, freshening and dewrinkling of clothing garments without the expense and inconvenience of taking soiled or stale-smelling clothes to a commercial dry cleaning establishment and picking the clothes up. The dryer dry cleaning and freshening system of the invention permits the user to lightly clean and freshen garments between dry cleaner visits. This reduces the overall cost of dry cleaning.

The containment bag 1 of the present invention performs a dual function. A first function is as a dispenser, as prior to use its interior is prewetted with an amount of a liquid cleaning composition; during tumbling in the dryer, the liquid cleaning composition is delivered to the garments being cleaned as they come into contact with this wetted interior. In its second function, stains and particulates, specifically loosened soils including particles and lint are transferred to the interior material of the bag where they are entrained or entrapped. Such a soft interior also acts to reduce friction damage which may be imparted to the garments during tumbling.

Figure 3:
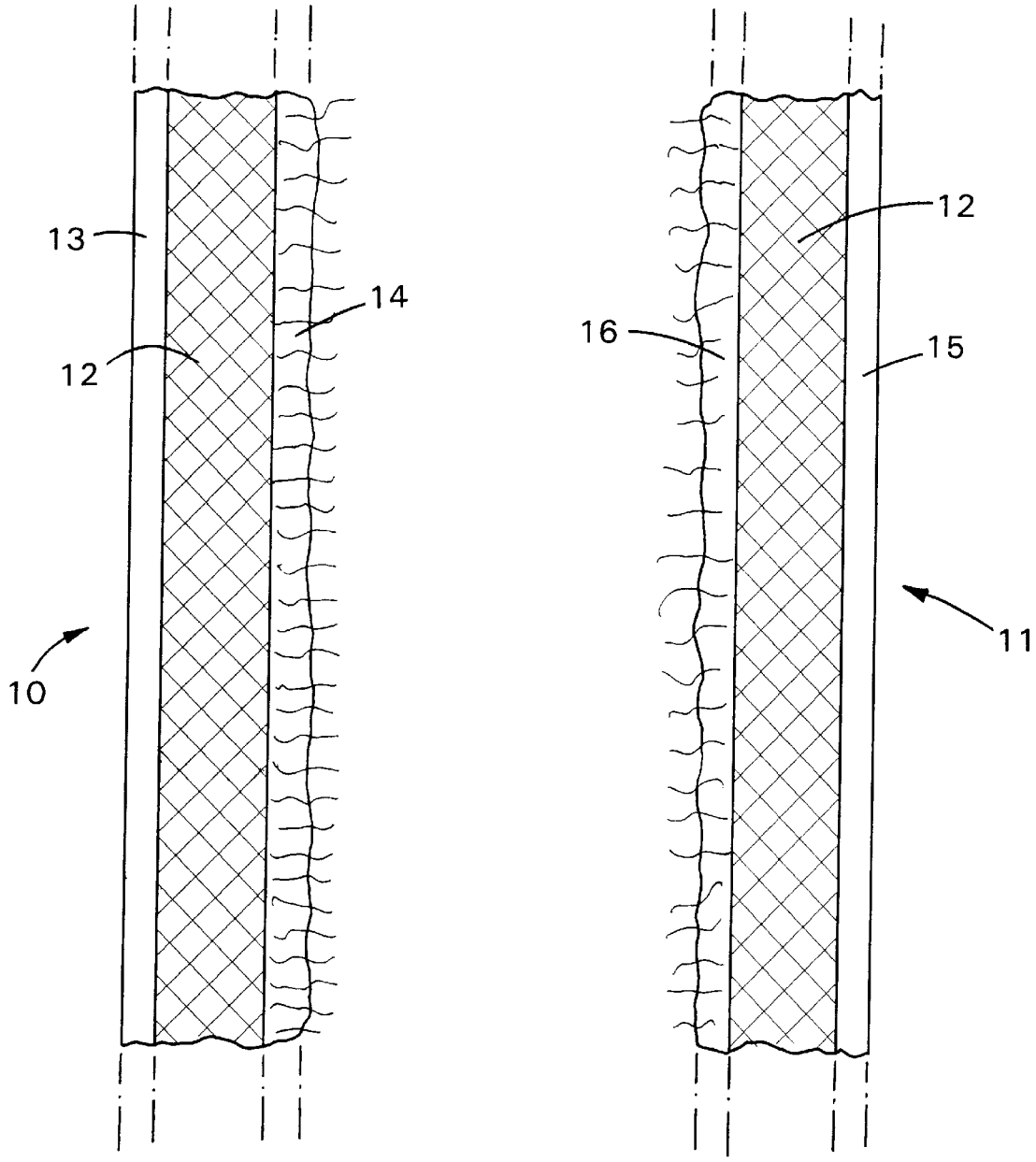
FIG. 3 is a partial cross-sectional schematic drawing of a trilaminate material construction used in the fabrication of the containment bag 1 in accordance with the present invention as taken along the line 3—3 of FIG. 1.

FIG. 3 is a partial cross-sectional schematic drawing of an exemplary trilaminate material of construction used in the fabrication of the containment bag 1 in accordance with the invention as taken along line 3—3 of FIG. 1. FIG. 3 illustrates two pieces 10 and 11 of a trilaminate containment bag 1. The pieces are shown in cross-section. Piece 11 of the dryer bag is shown in FIG. 1. The two pieces 10 and 11 are sewn together on three sides to form the bag with the opening at side 2. The trilaminate textile includes a woven fabric 12 for each piece. Piece 10 has an impermeable coating 13 on one side of the woven fabric 12 and a fleecy, soft, hairy layer 14 and 16 on the other side of the woven fabric 12 which is the facing in the interior of the containment bag 1. Piece 11 of the trilaminate textile has a woven fabric 12 with an impermeable coating 15 on one side and a soft, hairy layer on the other side 16. The soft layers 14 and 16 alternately may be velvet, or a textile material with either a cut pile surface or with closed loop surfaces, such as terry-cloth used to make cloth towels. In a still further alternative, the soft, hairy layers 14 and 16 may be a type of foam such as a flexible foamed polymer. The soft, hairy layers 14 and 16 provide a soft interior for the containment bag 1 which is attractive to consumers and does not damage delicate clothing. The inter-fiber spaces of these provide a volumetric particle trap to trap particles of dirt and lint, and thus act to entrain or entrap such particles. Of course, as has been discussed above, the soft interior of the containment bag 1 is sufficiently absorbent with respect to the liquid cleaning composition facilitating its prewetting with said composition before tumbling in a dryer.

In order to provide an impermeable finish for the textile containment bag 1, the textile is impregnated with a flexible resin finish, or with a film or other material providing vapor barrier properties as discussed previously; such a finish provides the vapor impermeable coatings or layers as illustrated by 13 and 15 of FIG. 3.

The two pieces 10 and 11 of the textile containment bag 1 may each be coated with a different finish. This provides diversified affinity, i.e. diversified attraction for lint and particles released during the tumbling action. For example, piece of textile 10 may have a hydrophilic finish while piece of textile 11 may have a hydrophobic finish. Accordingly, different types of stains may be removed by pieces of textile 10 and 11. The pieces of textile 10 and 11 may have different surface charges during tumbling. Providing a hydrophilic finish to one piece while providing a hydrophobic finish to the other piece is one manner of providing different surface charges. Alternatively, different fabric blends may be employed in the trilaminate structures of pieces 10 and 11. The different fabric blends may be chosen such that they naturally have different surface charges during tumbling. For example, fabrics made of cotton, polyester or polyethylene fibers have different surface charges during the tumbling action. Different types of stains, particles and lint may be removed by the diversified surface charges on the pieces of textile 10 and 11. The containment bag 1 may be made of a textile of highly elastic material.

In operation, an amount of a cleaning composition is preapplied to the containment bag 1. When a liquid cleaning composition is employed, the inside of the containment bag 1 is prewet with the liquid cleaning composition. This avoids a high concentration of liquid cleaning composition on the garment surface. Then, the garments to be cleaned are placed in the containment bag 1 and the containment bag 1 is fastened shut to avoid leakage of the liquid cleaning composition into the dryer. The dryer cleaning bag and its contents are tumbled in a clothes dryer. The clean garments are removed from the clothes dryer and containment bag 1. After use the containment bag 1 may be washed in a washing machine and reused. Before washing the bag may be turned inside-out.

Additionally, the home dryer dry cleaning and freshening system of the invention may include a quantity of stain remover. In operation, the stain remover may be applied directly to a garment before placement in the containment bag 1. Further, the system of the invention may include an additional quantity of liquid cleaning composition which may be added to the containment bag 1 before fastening the bag and placing it in the clothes dryer for tumbling.

In another embodiment of the invention, the interior of the dry cleaning bag may be impregnated with a fragrance composition alone for freshening garments.

The present invention is used in conjunction with a cleaning composition. Typically such a cleaning composition comprises one or more solvents and/or one or more surfactant constituents which may be employed to solubilize stains, and such cleaning compositions may be provided as part of an aqueous, or as part of an organic fluid delivery system. Compositions which comprise a fragrance constituent, with or without additional solvents and or surfactant constitutents may may also be used. Such surfactants and solvent, where present are generally known to aid in the removal of soils and stains from the garment or textile being treated in the process being taught herein. Exemplary useful cleaning compositions include those which are known to the skilled practioner in the art, and include those dislosed in any of the patents which are recited above, the contents of which are herein incorporated by reference. Exemplary useful liquid cleaning compositions include those which are known to the skilled practitioner in the art, and include those disclosed in any of the patents which are recited above, the contents of which are herein incorporated by reference. Further useful cleaning compositions which may be used include those which are the subject of copending patent application Ser. No. 08/666,689 which are liquid cleaning compositions which are particularly useful as a home dry cleaning composition. These liquid cleaning compositions comprising the following constituents: 0.01–5% wt. (preferably 0.01–2.5% wt.) nonionic surfactant which is preferably an alkoxylated primary or secondary alcohol and/or an alkoxylated phenol; 0.01–2.5% wt. anionic surfacant selected from alkyl sulfosuccinates, alkyl ether sulfosuccinates, alkylamide sulfosuccinates, alkyl sulfosuccinamates, as well as salt forms thereof; 0–1% wt. (preferably 0–0.1% wt.) fluorosurfactant constituent including one or more of those which may be present in the spot cleaning composition; 0.01–7% wt. organic solvent selected from alcohols and glycol ethers especially water miscible alcohols and ethers, to 100% wt. of water, and further up to about 2% wt. (preferably 0–1% wt.) of one or more optional constituents. Desirably, these compositions are aqueous in nature and comprise about 90% wt. and more of water. Further useful compositions are those which are taught as localized stain treating compositions, viz., spot treatment compositions which are described in Ser. No. 08/666,690. Therein are described aqueous spot cleaning composition which comprises the following constituents: 0.1–10% wt. nonionic alkoxylated alcohol; 0.1–10% wt. nonionic alkoxylated mono- and di-alkanol amide; 0.1–3.5% wt. anionic surfactant especially one or more selected from alkyl sulfosuccinates, alkyl ether sulfosuccinates, alkylamide sulfosuccinates, alkyl sulfosuccinamates, as well as salt forms thereof; 0–1% wt. flurosurfactant; 0.01–7% wt. alcohol solvent especially water miscible alcohols; 0.01–30% wt. glycol ether solvent, especially water miscible glycol ethers; to 100% wt. water. Optionally, these spot cleaning compositions may include up to about 2% wt. of one or more conventional additives such as acids, bases, pH buffers, coloring agents, fragrances and the like. Desirably, these spot cleaning compositions comprise at least about 70% wt. water. The contents of both of these applications are herein incorporated by reference.

In summary, preferably, the organic solvent or solvent mixture is non-toxic and water-miscible. Most preferably, the major portion of the solvent will be a glycol ether. Pyrrolidinone solvents can also be used. Alcohol can be employed as co-solvents in the present invention. Other useful co-solvents include alcohol for example: (a) lower (alkanols), (b) ketones, (c) $C_2$–$C_4$ polyols or mixtures thereof or (d) hydrocarbon solvents. Other organic solvents can also be used, including conventional chlorinated dry-cleaning solvent and mixtures of the foregoing as long as the final cleaning composition has a flash point above 160° F.

Nonionic surfactants and amphoteric surfactants are preferred for use in the present invention and can also act as adjunct fabric softeners. Nonionic surfactants include the condensation products of ethylene oxide with a hydrophobic polyoxyalkylene base formed by the condensation of propylene oxide with propylene glycol. Preferred nonionic surfactants include the condensation products of $C_8$–$C_{22}$ alkyl alcohol with 2–50 moles of ethylene oxide per mole of alcohol. Preferred nonionic surfactants also include ($C_8$–$C_{24}$) fatty acid amides, e.g. the monoamides of a mixture of arachidic and behenic acid and the mono- or di-alkanolamides of ($C_8$–$C_{22}$) fatty acids.

Other nonionic surfactants which may be employed include the ethylene oxide esters of $C_6$–$C_{12}$ alkyl phenols such as (nonylphenoxy) polyoxyethylene ether. Other useful nonionics include the ethylene oxide esters of alkyl mercaptans, the ethylene oxide esters of fatty acids and the lauric ester of methoxypolyethylene glycol, the ethylene oxide ethers of fatty acid amides, the condensation products of ethylene oxide with partial fatty acid esters of sorbital, wherein the mole ratio of ethylene oxide to the acid, phenol, amide or alcohol is about 5–50:1.

Useful amphoteric surfactants include the ($C_8$–$C_{22}$) alkyl (dimethyl)amine oxides. Other useful amphoteric surfactants are known to the art, e.g., as disclosed in Marshall et al. (U.S. Pat. No. 3,936,538).

Useful anionic surfactants are known to the art including sodium cocoyl isethionate, commercially available as Jordapon® CI from Mazer Chemicals, Gurnee, Ill. Anonionic surfactants may be optionally added in minor but effective amounts, e.g., up to about 1% in addition to the nonionic or amphoteric surfactant. One broad class of cationic surfactants is referred to as quaternary amines, or "quats". These materials can also function to condition the fabrics and to reduce static cling and lint adherence.

Other surfactants include one subclass of aliphatic quaternary amines, useful aliphatic quats, useful quaternary ammonium antistatic agents, such as imidazolinium salts and useful amine salts like the stearyl amine salts that are soluble in water.

Desirably, the cleaning composition is a liquid to avoid residue associated with gel and dry compositions, the need for a finishing cycle to remove a dry cleaning agent, and the need to trap and clean a dry cleaning agent from a dryer.

Additionally water may be present in the cleaning composition. Generally, sufficient water is employed to aid in the removal of water based stains.

The cleaning composition and fragrance composition should be such that there is no skin and eye irritation and preferably, no toxicity. Preferably a sufficient quantity of cleaning composition is provided to clean three garments per dry cleaning load.

The cleaning composition may include a fragrance, deodorant, preservative, insect repellent such as cedar oil, a coloring agent, finishing agents, fumigants, lubricants, and fungicides, as long as the additives do not interfere with the operation of the composition.

Different solvents may used for different types of stains depending on their source, age and size and for different types of fabrics depending on the blend, age and color of the fabric.

The amount of time a garment spends in a dryer influences the amount of wrinkling of the garment.

Although the invention has been described with reference to the preferred embodiments, it will be apparent to one skilled in the art that variations and modifications are contemplated within the spirit and scope of the invention. The drawings and the description of the preferred embodiments are made by way of example rather than to limit the scope of the invention, and it is intended to cover within the spirit and scope of the invention all such changes and modifications.

We claim:

1. A dryer dry cleaning and freshening system comprising:

a cleaning composition; and a reusable vapor-impermeable containment bag fabricated of a material comprising a first vapor-impermeable layer fabricated from (1) a material selected from the group consisting of synthetic paper material, polybutylene, polyalkylene terephthalate, and copolymers of polybutylene or of polyalkylene terephthalate, and (2) a second textile layer, wherein the containment bag has an inner surface of an absorbent material having inter-fiber spaces acting as a volumetric containment trap.

2. A dryer dry cleaning and freshening system according to claim 1 wherein the vapor impermeable containment bag is fabricated from a resin coated fleecy material.

3. A dryer dry cleaning and freshening system according to claim 1 wherein the second textile layer of said containment bag is a woven textile material.

4. A dryer dry cleaning and freshening system according to claim 1 wherein the second textile layer of said containment bag is a non-woven textile material.

5. A dryer dry cleaning and freshening system according to claim 1 wherein the second textile layer of said containment bag is a textile material having a cut pile surface.

6. A dryer dry cleaning and freshening system according to claim 1 wherein the second textile layer of said containment bag is a textile material having a closed loop pile surface.

7. A dryer dry cleaning and freshening system according to claim 1 wherein the vapor impermeable containment bag is fabricated of a laminated material having at least one vapor impermeable layer, and a second liquid absorbent layer.

8. A dryer dry cleaning and freshening system according to claim 1, wherein said containment bag includes an opening and a pull string adapted to fasten said opening shut.

9. A dryer dry cleaning and freshening system according to claim 1, wherein said containment bag includes a flexible support structure.

10. A dryer dry cleaning and freshening system according to claim 9, wherein said support structure is a plastic ring.

11. The dryer dry cleaning and freshening system of claim 1, wherein the containment bag is fabricated of synthetic paper material.

12. The dryer dry cleaning and freshening system of claim 1, wherein the containment bag is fabricated of polybutylene, polyalkylene terephthalate, or said copolymers.

13. A process for cleaning a garment with a liquid cleaning composition comprising the steps of:

applying a quantity of a liquid cleaning composition to the interior of a vapor-impermeable containment bag fabricated from a material selected from the group consisting of synthetic paper material, polybutylene, polyalkylene terephthalate, and copolymers of polybutylene or of polyalkylene terephthalate, wherein the material has an inner surface of an absorbent material having inter-fiber spaces acting as a volumetric particle trap;

placing at least one garment into said containment bag;

sealing said containment bag;

tumbling said containment bag and contents in a clothes dryer; and removing the cleaned garment from said clothes dryer and from the containment bag.

14. The process according to claim 13, further comprising the process step of:

applying directly to the surface of the at least one garment a quantity of the liquid cleaning composition.

15. The process according to claim 13, further comprising the process step of:

prior to the insertion of the at least one garment into the containment bag, treating the surface of said garment with a spot cleaning composition.

16. The process according to claim 13, further comprising tumbling the containment bag containing the at least one garment for about 10 to 20 minutes.

17. The process of claim 13, wherein the clothes dryer is a heated home clothes dryer.

18. The process of claim 13, wherein the containment bag is fabricated of synthetic paper material.

19. The process of claim 13, wherein the containment bag is fabricated of polybutylene, polyalkylene terephthalate, or said copolymers.

20. A process for freshening a garment with a fragrance composition comprising the steps of:

applying a quantity of a liquid cleaning composition which composition includes a fragrance composition to the interior of a vapor-impermeable containment bag fabricated from a material selected from the group consisting of synthetic paper material, polybutylene, polyalkylene terephthalate, and copolymers of polybutylene or of polyalkylene terephthalate, having an inner surface of an absorbent material having inter-fiber spaces acting as a volumetric particle trap;

placing at least one garment into said containment bag;

sealing said containment bag;

tumbling said containment bag and contents in a clothes dryer; and removing the freshened garment from said clothes dryer and containment bag.

* * * * *